US009275785B2

(12) United States Patent
Shin

(10) Patent No.: US 9,275,785 B2
(45) Date of Patent: Mar. 1, 2016

(54) MULTILAYERED POWER INDUCTOR AND METHOD FOR PREPARING THE SAME

(71) Applicant: SAMSUNG ELECTRO-MECHANICS CO., LTD., Suwon-si, Gyeonggi-do (KR)

(72) Inventor: Sung Sik Shin, Busan (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 4 days.

(21) Appl. No.: 14/078,231

(22) Filed: Nov. 12, 2013

(65) Prior Publication Data

US 2014/0132387 A1 May 15, 2014

(30) Foreign Application Priority Data

Nov. 13, 2012 (KR) ..... 10-2012-0128155

(51) Int. Cl.

| | |
|---|---|
| ***H01F 5/00*** | (2006.01) |
| ***H01F 27/255*** | (2006.01) |
| ***H01F 27/28*** | (2006.01) |
| ***H01F 1/33*** | (2006.01) |
| *H01F 1/26* | (2006.01) |

(52) U.S. Cl.

CPC ..... *H01F 27/255* (2013.01); *H01F 1/33* (2013.01); *H01F 27/2804* (2013.01); *H01F 1/26* (2013.01)

(58) Field of Classification Search

CPC ..... H01F 5/00; H01F 27/00–27/30

USPC ..... 336/65, 83, 200, 232

See application file for complete search history.

(56) References Cited

U.S. PATENT DOCUMENTS

| | | | | |
|---|---|---|---|---|
| 5,985,466 | A * | 11/1999 | Atarashi et al. | 428/570 |
| 6,261,691 | B1 * | 7/2001 | Atarashi et al. | 428/403 |
| 2008/0136574 | A1 * | 6/2008 | Jow et al. | 336/200 |
| 2012/0126165 | A1 * | 5/2012 | An et al. | 252/62.58 |

FOREIGN PATENT DOCUMENTS

| | | | |
|---|---|---|---|
| JP | 2002-359118 | A | 12/2002 |
| JP | 2009-105368 | A | 5/2009 |

* cited by examiner

*Primary Examiner* — Tuyen Nguyen

(74) *Attorney, Agent, or Firm* — McDermott Will & Emery LLP

(57) ABSTRACT

Disclosed herein are a multilayered power inductor including an inner electrode coil pattern formed on a ceramic substrate; an outer electrode layer; and a magnetic layer made of a metal powder insulated along a grain interface of the metal powder included in a part or the whole of a chip, and a method for preparing the same. According to the exemplary embodiments of the present invention, the magnetic layer made of the metal powder insulation-coated with the ceramic material along the grain interface of the magnetic metal powder can be used for a part or the whole of the chip, thereby increasing the filling ratio of the magnetic metal powder to 90% within the magnetic layer. Therefore, a high-capacity power inductor can be implemented to effectively improve efficiency characteristics.

5 Claims, 4 Drawing Sheets

- PRIOR ART -

- PRIOR ART -

- PRIOR ART -

MULTILAYERED POWER INDUCTOR AND METHOD FOR PREPARING THE SAME

CROSS REFERENCE(S) TO RELATED APPLICATIONS

This application claims the benefit under 35 U.S.C. Section 119 of Korean Patent Application Serial No. 10-2012-0128155 entitled "Multilayered Power Inductor And Method For Preparing The Same" filed on Nov. 13, 2012, which is hereby incorporated by reference in its entirety into this application.

BACKGROUND OF THE INVENTION

1. Technical Field

The present invention relates to a multilayered power inductor and a method for preparing the same.

2. Description of the Related Art

As a demand for small, thin, and multi-functional electronic products is increased, a multilayered power inductor also requires large-current components. In order to improve high-current characteristics keeping pace with thinness and multi-functional characteristics, there is a need to reform a material and utilize advantages between respective materials based on complexation of the materials.

In the case of the multilayered power inductor, as a material of a magnetic layer body, ferrite having a quaternary structure such as Ni—Zn—Cu—Fe is used. However, a saturation magnetization value of the material is lower than that of a metallic material, such that it is difficult to implement specifications required for high current characteristics. Therefore, a mixture of the ferrite material and a metal alloy has been mainly used.

As the power inductor becomes smaller and smaller, it is difficult to increase capacity. Therefore, in order to increase capacity, there is a need to increase a volume ratio of a metal alloy that is a magnetic material. To this end, the related art has used a method for mixing a large particle with a small particle at a predetermined ratio with resin to maximally increase a filling ratio. In this case, a volume ratio of the magnetic material may be difficult to implement 85% or more.

As in a sectional structure of FIG. 1, the multilayered power inductor according to the related art is configured to include a magnetic layer body 10 made of a ferrite material having a quaternary structure such as Ni—Zn—Cu—Fe, an inner electrode layer 20, and an outer electrode layer 30. The inner electrode layer 20 and the outer electrode layer 30 mainly use silver (Ag) and the outer electrode layer 30 may further include a plating layer.

Referring to FIG. 2A schematically illustrating an inside of the multilayered power inductor, the magnetic layer body 10 is formed by dispersing a metal powder 11 made of a metal alloy within an insulating resin 12. In this case, the inner electrode layer 20 has mainly used an electrode made of silver (Ag) or copper (Cu).

However, in the case of the metal powder made of the metal alloy forming the magnetic layer 10, a saturation magnetization value is high or a high frequency eddy current loss and a hysteresis loss are increased, such that a material loss may be severe in a high frequency. Therefore, as illustrated in FIG. 2B, in order to reduce the loss of the metal alloy powder 11 having the high eddy current loss, a surface may be coated with glass.

As the insulating resin 12 used for the magnetic layer 10 an epoxy resin is mainly used, which serves to insulate between the metal alloys.

In order to maximally increase capacity of the multilayered power inductor, there is a need to maximally increase the filling ratio of the metal alloy powder (magnetic material) of the magnetic layer implementing magnetic characteristics. To this end, the multilayered power inductor has a structure which a powder having a large grain size is mixed with a powder having a small grain size at an optimal ratio to maximally increase a content of the metal alloy powder and uses an insulating resin as a matrix to support this.

However, even in this case, the metal alloy powders structurally have empty spaces, such that there is a limitation in increasing the filling ratio of the metal alloy powder to 85% or more within the magnetic layer. As a result, it is very difficult to improve the capacity characteristics of the multilayered power inductor.

RELATED ART DOCUMENT

Patent Document (Patent Document 1) Japanese Patent Laid-Open Publication No. 2009-105368

SUMMARY OF THE INVENTION

An object of the present invention is to provide a structure of a multilayered power inductor with improved capacity characteristics by increasing a filling ratio of a magnetic material included in a magnetic layer.

Another object of the present invention is to provide a method for preparing a multilayered power inductor.

According to an exemplary embodiment of the present invention, there is provided a multilayered power inductor, including: an inner electrode coil pattern formed on a ceramic substrate; an outer electrode layer; and a magnetic layer made of a metal powder insulated along a grain interface of the metal powder included in a part or the whole of a chip.

When the magnetic layer made of the metal powder insulated along the grain interface of the metal powder is included in the whole of the chip, the magnetic layer may be made of only the metal powder insulated along the grain interface of the metal powder.

When the magnetic layer made of the metal powder insulated along the grain interface of the metal powder is included in the whole of the chip, a surface of the inner electrode coil pattern may be insulated.

When the magnetic layer made of the metal powder insulated along the grain interface of the metal powder is included in a part of the chip, the magnetic layers may be formed on upper and lower covers of the chip.

When the magnetic layer made of the metal powder insulated along the grain interface of the metal powder is included in a part of the chip, a magnetic body may include a metal powder and an organic binder.

The metal powder of the chip body may use a mixture of a powder of which D50 is 20 to 25 μm and a powder of which D50 is 4 to 5 μm.

When the magnetic layer made of the metal powder insulated along the grain interface of the metal powder is included in a part of the chip, the surface of the inner electrode coil pattern may be insulated.

The metal powder in the insulated metal powder may use D50 having 25 to 40 μm.

The metal powder in the insulated metal powder may be one or more selected from a group consisting of NiZnCu ferrite, iron (Fe), nickel (Ni), and an alloy with other metals.

In order to insulate the metal powder interface and insulate the inner electrode coil pattern, a $SiO_2$—based ceramic material may be used.

At the time of the insulation of the metal powder interface and the inner electrode coil pattern, $Fe_2O_3$ may be optionally used.

According to another exemplary embodiment of the present invention, there is provided an multilayered power inductor, including: an inner electrode coil pattern formed on a ceramic substrate; a magnetic body formed inside and outside of a core of the inner electrode coil pattern; and magnetic layers made of a metal powder insulated along a grain interface of the metal powder included in upper and lower covers of the chip on which the inner electrode coil pattern is formed.

According to another exemplary embodiment of the present invention, there is provided a method for preparing a multilayered power inductor, the method including: forming an inner electrode coil pattern on a ceramic substrate; forming a magnetic layer on the substrate having the inner electrode coil pattern formed thereon by filling a metal powder insulated along a grain interface of the metal powder in a part or the whole of a chip; and forming an external electrode layer.

The method may further include: when the magnetic layer is formed in the whole of the chip, after the forming of the inner electrode coil pattern on the ceramic substrate, insulating the inner electrode coil pattern by dipping the inner electrode coil pattern in an insulating coating solution.

When the magnetic layer is formed in a part of the chip, a magnetic body may be formed by filling the insulated metal powder and organic binder inside and outside of a core of the inner electrode coil pattern during the filling of the magnetic material, and upper and lower portions of the chip body may be formed with a magnetic bar made of a metal power insulated along a grain interface of the metal powder.

The magnetic bars formed on the upper and lower portions of the chip body may be formed by curing the organic binder included in the chip body.

DESCRIPTION OF THE PREFERRED EMBODIMENTS

Hereinafter, exemplary embodiments of the present invention will be described in detail with reference to the accompanying drawings.

Terms used in the present specification are for explaining the embodiments rather than limiting the present invention. Unless explicitly described to the contrary, a singular form includes a plural form in the present specification. The word comprise and variations such as "comprises and/or comprising" will be understood to imply the inclusion of stated constituents, steps, operations and/or elements but not the exclusion of any other constituents, steps, operations and/or elements.

The present invention relates to a multilayered power inductor capable of improving capacity characteristics of an inductor by increasing a filling ratio of a magnetic material that is a metal powder forming a magnetic layer and a method for preparing a multilayered power inductor.

Figure 3:
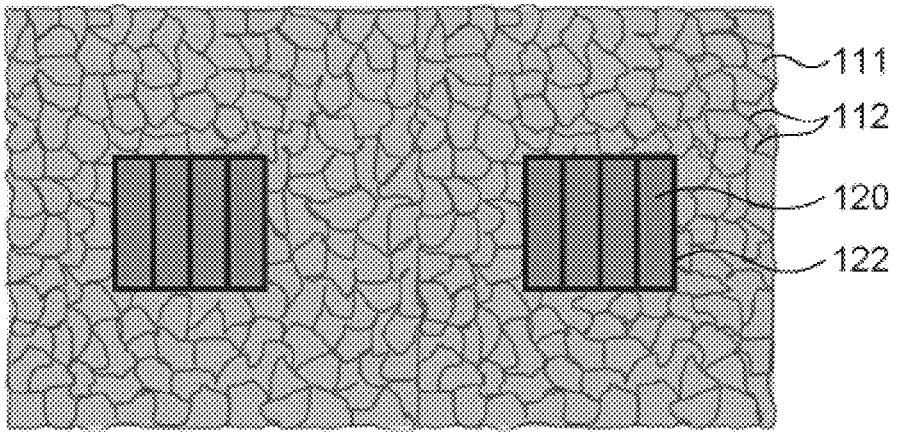
FIG. 3 is a diagram schematically illustrating inside of a multilayered power inductor according to an exemplary embodiment of the present invention.

Next, FIG. 3 illustrates an inner structure of a multilayered power inductor according to a first exemplary embodiment of the present invention. Referring to FIG. 3, a magnetic layer 110 made of a metal powder insulation-coated along a grain interface of the metal powder 111 is included in the whole chip and includes inner electrode coil patterns 120 of which the surface is insulated 122 and an outer electrode (not illustrated).

According to the multilayered power inductor according to the exemplary embodiment of the present invention, the magnetic layer 110 is formed in the whole chip by using the metal powder 111 that is insulation-coated 112 with a specific ceramic material along the grain interface of the metal powder 111 and the surface of the inner electrode coil pattern 120 is insulation-coated with the same ceramic material that insulation-coats 112 the metal powder 111.

In order to increase the filling ratio of the metal powder, the metal powder of the magnetic layer use a D50 having a size of 15~40 μm. However, there is a problem in that when the grain size of the metal powder uses D50 less than 15 μm, a volume fraction of an insulation coating layer is increased, such that the filling ratio of the metal powder is small, and when the grain size of the metal powder uses D50 exceeding 40 μm, the eddy current loss may be increased.

In addition, the metal powder is insulated-coated with the ceramic material along the grain interface of the metal powder, such that the metal powder may have a flake shape, not a spherical shape. The metal powder may be made of one or more selected from a group consisting of NiZnCu ferrite, iron (Fe), nickel (Ni), and an alloy with other metals. As the other metals, there may be Si, Al, and the like, but the present invention is not limited thereto.

For the insulation of the metal powder used for the magnetic layer, a $SiO_2$—based ceramic material may be used and optionally, metal oxide such as $Fe_2O_3$ may be used, but the present invention is not limited thereto.

When the magnetic layer 110 is included in the whole chip, the magnetic layer 110 may be prepared by insulation-coating a flake-shaped metal powder with the ceramic material, compressing the metal powder at high pressure, and heat-treating the metal powder under reduced atmosphere. Therefore, the magnetic layer 110 according to the first exemplary embodiment of the present invention includes only the metal powder 111 insulation-coated 112 with a specific ceramic material along the grain interface of the metal powder 111 and does not include an organic binder and a solvent that are included in the metal powder 111 as in the related art.

According to the first exemplary embodiment of the present invention, the magnetic layer is formed by forming the metal powder insulation-coated with the ceramic material as it is, such that the filling ratio of the metal powder may be increased to 90% within the magnetic layer. Therefore, the high-capacity power inductor can be implemented to effectively improve the efficiency characteristics.

Further, the surface of the inner electrode coil pattern 120 according to the first exemplary embodiment of the present invention may be insulation-coated with the same ceramic material, like the metal powder of the magnetic layer. That is, for the insulation of the inner electrode coil pattern 120, the $SiO_2$—based ceramic material may be used and optionally, metal oxide such as $Fe_2O_3$ may be used, but the present invention is not limited thereto. In this case, a possibility of a short between the inner electrode coil patterns 120 may be previously blocked.

Figure 4:
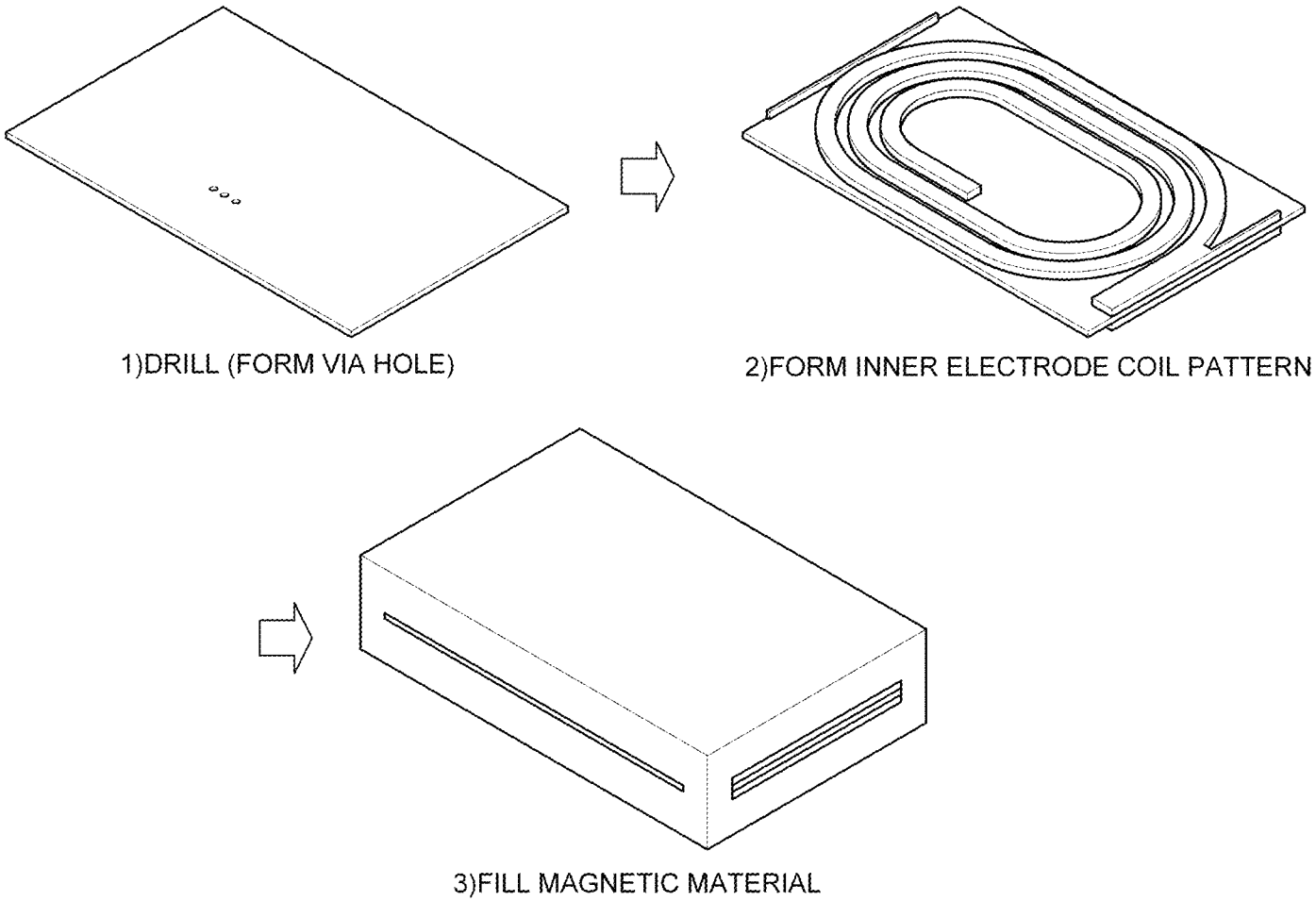
FIG. 4 is a diagram illustrating a process for manufacturing the multilayered power inductor according to the exemplary embodiment of the present invention.

A method for preparing the multilayered power inductor according to the first exemplary embodiment of the present invention is illustrated in FIG. 4. Referring to FIG. 4, a ceramic substrate is first prepared and a via hole is formed on the ceramic substrate by a drilling method, and the like. The inner electrode coil pattern is formed on the substrate on which the via hole is formed, by a chemical plating method.

Next, after the substrate on which the inner electrode coil pattern is formed is etched, the substrate is dipped in a ceramic insulation coating solution and dried to insulate the surface of the inner electrode coil pattern.

The inner electrode coil pattern is insulation-processed and then the magnetic layer is formed by filling and curing the magnetic material to prepare the chip. The magnetic layer may be prepared by being insulation-coated with the ceramic material along the interface of the flake-shape metal powder, compressed at high pressure, and heat-treated under the reduction atmosphere. In the following post-process, the multilayered power inductor is prepared by the same method as the existing multilayered inductor, by forming an outer electrode, a plating layer, and the like, by cutting, polishing, and the like.

Figure 5:
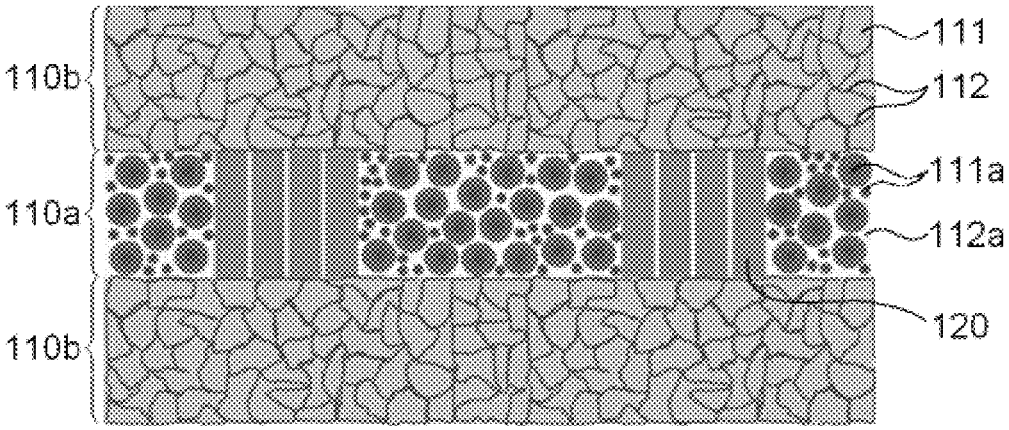
FIGS. 5 and 6 are diagrams schematically illustrating inside of a multilayered power inductor according to another exemplary embodiment of the present invention.

Next, FIG. 5 illustrates an inner structure of the multilayered power inductor according to a second exemplary embodiment of the present invention. Referring to FIG. 5, the multilayered power inductor includes a magnetic body 110*a* that includes a metal powder and an organic binder formed inside and outside of a core of the inner electrode coil pattern 120, magnetic bars 110*b* made of the metal powder insulation-coated along the grain interface of the metal powder 111 and formed on upper and lower covers of the magnetic body 110*a*, the inner electrode coil pattern 120, and an outer electrode (not illustrated).

According to the second exemplary embodiment of the present invention, the multilayered power inductor has a structure in which the magnetic layer made of the metal powder insulation-coated 112 along the grain interface of the metal powder 111 is included in a part of the multilayered power inductor, that is, the upper and lower portions of the chip body, in detail, a structure in which the magnetic body 110*a* including a metal powder 111*a* and an organic binder 112*a* is formed inside and outside of the core of the inner electrode coil pattern 120 as in the related art and the magnetic layers formed of the magnetic bar 110*b* made of the metal powder insulation-coated along the grain interface of the metal powder 111 are partially formed only on the upper and lower portions thereof.

The magnetic material filled in the magnetic body 110*a* preferably uses a mixture of a powder of which D50 is 20 to 25 μm and D50 is 4 to 5 μm as the metal powder made of the NiZnCu ferrite in order to increase the filling ratio of the metal powder and may include an organic binder such as epoxy resin and a general solvent.

Further, the metal powder filled in the magnetic bar 110*b* uses D50 having a size of 15 to 40 μm in order to increase the filling ratio of the metal powder and is insulation-coated with the ceramic material along the grain interface thereof, such that the metal powder may have a flake shape, not a spherical shape. The metal powder may be made of one or more selected from a group consisting of NiZnCu ferrite, iron (Fe), nickel (Ni), and an alloy with other metals. As the other metals, there may be Si, Al, and the like, but the present invention is not limited thereto.

Further, for the insulation of the metal powder used for the magnetic layer, a $SiO_2$—based ceramic material may be used and optionally, metal oxide such as $Fe_2O_3$ may be used, but the present invention is not limited thereto.

The magnetic bar 110*b* may be prepared by insulation-coating the flake-shaped metal powder with the ceramic material, compressed at high pressure, and heat-treated under reduced atmosphere.

A method for preparing the multilayered power inductor according to the second exemplary embodiment of the present invention is illustrated in FIG. 4. Referring to FIG. 4, a ceramic substrate is first prepared and a via hole is formed on the ceramic substrate by a drilling method, and the like. The inner electrode coil pattern is formed on the substrate on which the via hole is formed, by a chemical plating method. Next, the chip may be prepared by filling and curing the magnetic material.

According to the second exemplary embodiment of the present invention, the multilayered power inductor has a structure in which the magnetic body 110*a* is formed by filling the magnetic material and the magnetic bars 110*b* are formed on the upper and lower portions thereof. That is, the magnetic body 110*a* is formed by filling the same metal powder and organic binder only inside/outside of the inner electrode coil pattern 120 during the magnetic filling process, and the cover portion (upper and lower portions) thereof is laminated with the magnetic bar 110*b* made of the metal powder insulation-coated along the grain interface of the metal powder 111 and is then cured.

The magnetic bar 110*b* may be bonded by curing the organic binder included in the magnetic body 110*a*.

In the following post-process, the multilayered power inductor is prepared by the same method as the existing multilayered inductor, by formation of outer electrode, a plating layer, and the like, by cutting, polishing, and the like.

Figure 6:
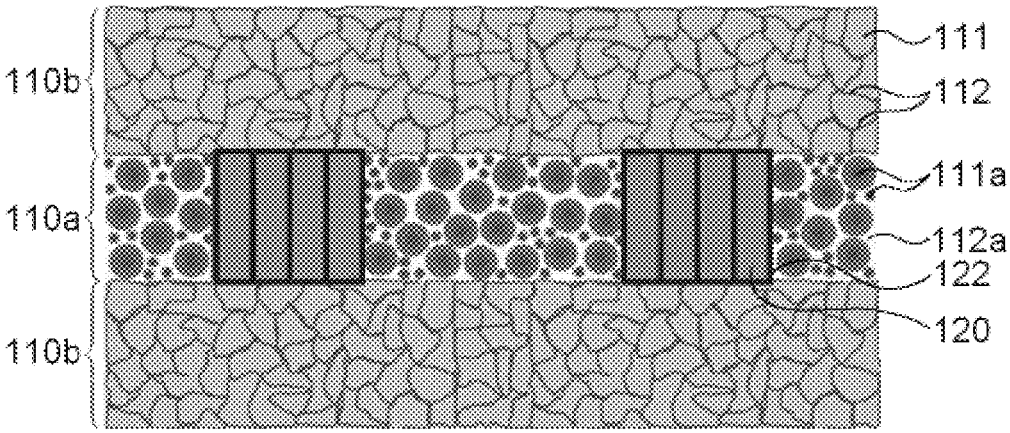

Next, FIG. 6 illustrates an inner structure of a multilayered power inductor according to a third exemplary embodiment of the present invention. Referring to FIG. 5, the multilayered power inductor includes the magnetic body 110*a* that includes a metal powder and an organic binder formed inside and outside of the core of the inner electrode coil pattern 120, the magnetic bars 110*b* made of the metal powder insulation-coated along the grain interface of the metal powder 111 and formed on the upper and lower covers of the magnetic body 110*a*, the inner electrode coil pattern 120 of which the surface is insulated, and the outer electrode (not illustrated).

According to the third exemplary embodiment of the present invention, the multilayered power inductor has a structure in which the magnetic bar that is the magnetic layer made of the metal powder insulation-coated 112 along the grain interface of the metal powder 111 is included only in a part of the chip, in detail, a structure in which the magnetic body 110*a* including the metal powder and the organic binder is formed inside and outside of the core of the inner electrode coil pattern 120 as in the related art and the magnetic bars 110*b* made of the metal powder insulation-coated along the grain interface of the metal powder 111 are formed only on the upper and lower portions thereof. Further, at the same time, it is preferable to use the surface of the inner electrode coil pattern 120 that is insulated 122.

The magnetic material filled in the magnetic body preferably uses a mixture of a powder of which D50 is 20 to 25 μm and D50 is 4 to 5 μm in order to increase the filling ratio of the metal powder and may include an organic binder such as epoxy resin and a general solvent.

Further, the metal powder filled in the magnetic bar uses D50 having a size of 15 to 40 μm in order to increase the filling ratio of the metal powder and is insulation-coated with the ceramic material along the grain interface thereof, such that the metal powder may have a flake shape, not a spherical shape. The metal powder may be made of one or more selected from a group consisting of NiZnCu ferrite, iron (Fe), nickel (Ni), and an alloy with other metals. As the other metals, there may be Si, Al, and the like, but the present invention is not limited thereto.

Further, for the insulation of the metal powder used for the magnetic bar, a $SiO_2$—based ceramic material may be used and optionally, metal oxide such as $Fe_2O_3$ may be used, but the present invention is not limited thereto.

The magnetic bar 110*b* may be prepared by insulation-coating the flake-shaped metal powder with the ceramic material, compressed at high pressure, and heat-treated under the reduction atmosphere.

Further, the surface of the inner electrode coil pattern 120 according to the third exemplary embodiment of the present invention may be insulation-coated with the same ceramic material, like the metal powder of the magnetic bar. In this case, the possibility of a short between the inner electrode coil patterns 120 may be previously blocked.

A method for preparing the multilayered power inductor according to the third exemplary embodiment of the present invention is illustrated in FIG. 4. Referring to FIG. 4, a ceramic substrate is first prepared and a via hole is formed on the ceramic substrate by a drilling method, and the like. The inner electrode coil pattern is formed on the substrate on which the via hole is formed, by a chemical plating method.

Next, after the substrate on which the inner electrode coil pattern is formed is etched, the substrate is dipped in a ceramic insulation coating solution and dried to insulate the surface of the inner electrode coil pattern.

The chip may be prepared by insulation-processing the inner electrode coil pattern and then filling and curing the magnetic material. According to the third exemplary embodiment of the present invention, the multilayered power inductor has a structure in which the magnetic body 110*a* is formed by filling the magnetic material and the magnetic bars 110*b* are formed on the upper and lower portions thereof.

That is, the magnetic body 110 is formed by filling the magnetic material including the same metal powder and organic binder as the related art only inside/outside of the inner electrode coil pattern 120 during the magnetic filling process, and the cover portion (upper and lower portions) thereof is laminated with the magnetic bar 110*b* made of the metal powder insulation-coated along the grain interface of the metal powder 111 and is then cured. The magnetic bar made of the metal powder insulation-coated along the grain interface of the metal powder 111 formed on the cover portion (upper and lower portions) of the inner electrode coil pattern 120 may be bonded as the organic binder included in the magnetic body is cured.

The multilayered power inductor is prepared by the same method as the existing multilayered inductor, by forming the outer electrode, a plating layer, and the like, such as cutting, polishing, and the like, in the following post-process.

Only the multilayered inductor is described in detail by way of example, but the inductor according to the present invention may be applied to a winding type inductor, a multilayered inductor, and a thin film type inductor and therefore, is not particularly limited to anyone thereof.

Hereinafter, Examples of the present invention will be described. The following Examples are only to exemplify the present invention, and the scope of the present invention should not be interpreted to being limited to these Examples. Further, although the following Examples exemplify the present invention using specific compounds, it is obvious to those skilled in the art that the same or similar effect may also be generated in the case of using equivalents to the specific compounds.

Comparative Example 1

Figure 1:
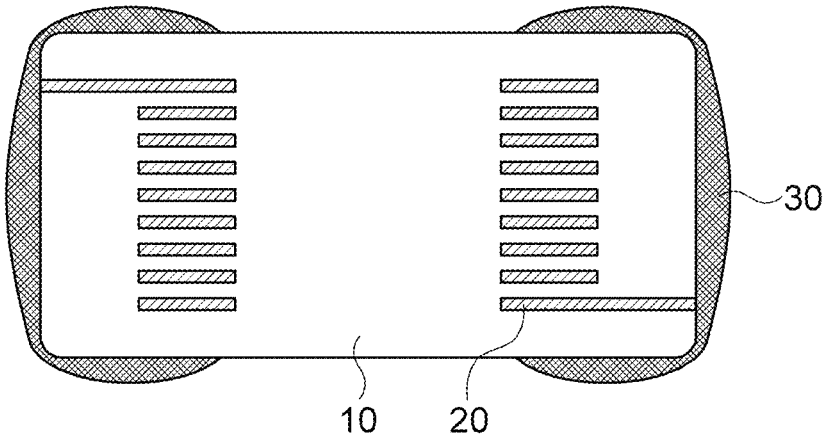
FIG. 1 is a diagram illustrating a general structure of a multilayered power inductor.
Figure 2A:
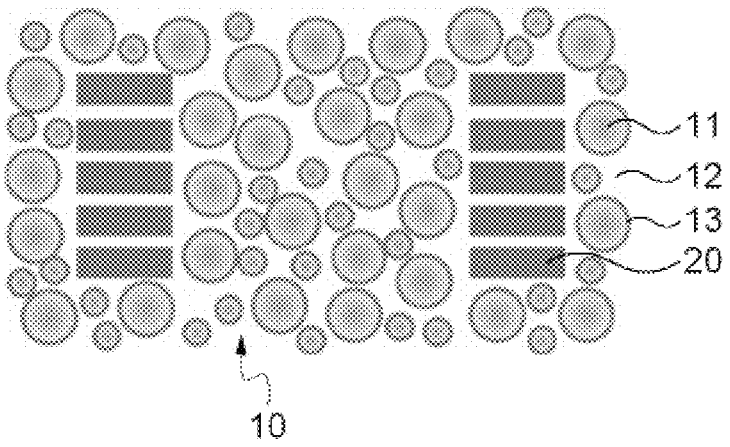
FIGS. 2A and 2B are diagrams schematically illustrating inside of a multilayered power inductor according to the related art.
Figure 2B:
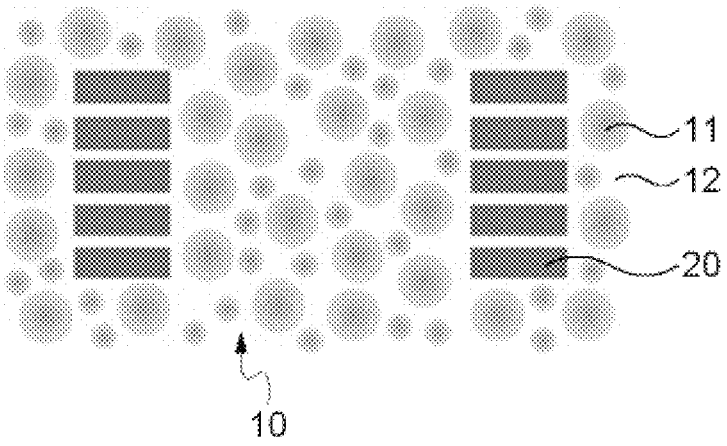

Next, the multilayered power inductor having the structure of FIG. 2A was prepared. First, the ceramic substrate was formed the via hole by drilling and was formed with the inner electrode coil pattern by the chemical plating. The turn number of the inner electrode coil pattern was set to be 8.5 turns. Next, a dry film resist was applied on the inner electrode coil pattern and then subjected to an exposing and developing process.

Next, the substrate was plated, delaminated, and etched, applied with PSR, and again subjected to the exposing and developing process. In addition, the magnetic layer was formed by drilling the inside of the inner electrode coil pattern and then filling the magnetic material. In the following post-process, the outer electrode was formed by being cut and polished in a chip unit. The multilayered inductor was prepared by forming the plating layer on the outer electrode if necessary.

The magnetic material of the magnetic layer used a mixture of D50=20 to 25 μm and D50=4 to 5 μm as a 10Si-5.5Al-84.5Fe powder having a spherical shape and used a composition including an epoxy resin.

Example 1

Next, according to the process of FIG. 4, the multilayered power inductor having the structure of FIG. 5 was prepared.

The magnetic body was formed by filling the same magnetic material as Comparative Example 1. Next, the magnetic bar insulation-coated with the $SiO_2$—based ceramic material along the grain interface of the metal powder was prepared by coating the 10Si-5.5Al-84.5Fe powder having D50=25 to 40 μm and a flake shape with the $SiO_2$—based ceramic material and thermally compressed.

The prepared magnetic bar was attached to the cover portion (upper and lower portions) of the chip body and cured, such that the magnetic layer formed of the magnetic bar is included in a part of the chip. The multilayered inductor was prepared by performing the following process in the same method as the process of Comparative Example 1.

Example 2

Next, according to the process of FIG. 4, the multilayered power inductor having the structure of FIG. 5 was prepared. First, the ceramic substrate was formed with the via hole by drilling and was formed with the inner electrode coil pattern by the chemical plating. The substrate on which the inner electrode coil pattern is formed was dipped in the $SiO_2$—based ceramic insulation coating solution to insulation coating the inner electrode coil pattern.

Further, the multilayered inductor was prepared by performing the following process in the same method as the process of Comparative Example 1, except that the magnetic layer is formed by filling the metal powder insulated with the $SiO_2$—based ceramic material along the grain interface of the metal powder having D50=25 to 40 μm as the 10Si-5.5Al-84.5Fe having the flake shape during the magnetic filling process of the Comparative Example 1.

Experimental Example 1

Capacity Evaluation

The capacity characteristics of the multilayered power inductor prepared according to the above Comparative Example 1 and Examples 1 and 2 were evaluated and the results thereof were shown in the following Table 1. The results were obtained by preparing and measuring three samples for each specimen.

TABLE 1

| | Comparative Example 1 | | | Example 1 | | | Example 2 | | |
|---|---|---|---|---|---|---|---|---|---|
| Division | SPL1 | SPL2 | SPL3 | SPL1 | SPL2 | SPL3 | SPL1 | SPL2 | SPL3 |
| Capacity uH) | 1.02 | 1.03 | 1.00 | 1.85 | 1.89 | 1.92 | 2.52 | 2.56 | 2.49 |

As in the results of the above Table 1, as a result of including the metal powder insulation-coated along the grain interface of the magnetic metal powder as the magnetic layer of the multilayered power inductor according to the present invention in a part (Example 1) or the whole (Example 2) of the chip, the filling ratio of the metal powder may be increased to 90% or more within the magnetic layer and high capacity is implemented at the time of preparing the power inductor, thereby increasing the efficiency characteristics.

In addition, the eddy current loss, that is, the material loss can be maximally reduced by using the magnetic metal powder of the magnetic layer having a small particle size (average grain size of 40 μm or less) and insulated with the ceramic component.

Further, the short occurrence between the inner electrode coil patterns can be prevented by insulating the inner electrode coil patterns.

According to the exemplary embodiments of the present invention, the magnetic layer made of the metal powder insulation-coated with the ceramic material along the grain interface of the magnetic metal powder can be used for a part or the whole of the chip, thereby increasing the filling ratio of the magnetic metal powder to 90% within the magnetic layer. Therefore, the high-capacity power inductor can be implemented to effectively improve the efficiency characteristics.

In addition, according to the exemplary embodiments of the present invention, the eddy current loss, that is, the material loss can be maximally reduced by using the metal powder having a small grain size and insulating the metal powder with the ceramic component.

Further, shorts that occur between the inner electrode coil patterns can be prevented by insulating the inner electrode coil patterns.

The present invention has been described in connection with what is presently considered to be practical exemplary embodiments. Although the exemplary embodiments of the present invention have been described, the present invention may be also used in various other combinations, modifications and environments. In other words, the present invention may be changed or modified within the range of concept of the invention disclosed in the specification, the range equivalent to the disclosure and/or the range of the technology or knowledge in the field to which the present invention pertains. The exemplary embodiments described above have been provided to explain the best state in carrying out the present invention. Therefore, they may be carried out in other states known to the field to which the present invention pertains in using other inventions such as the present invention and also be modified in various forms required in specific application fields and usages of the invention. Therefore, it is to be understood that the invention is not limited to the disclosed embodiments. It is to be understood that other embodiments are also included within the spirit and scope of the appended claims.

What is claimed is:

1. A multilayered power inductor, comprising:

a magnetic layer included in at least a part of a power inductor chip body;

an inner electrode coil pattern formed in the magnetic layer; and an outer electrode layer, wherein the magnetic layer comprises a metal powder insulated along a grain interface of the metal powder, and an $SiO_2$-based ceramic material insulates the grain interface of the metal powder and the surface of the inner electrode coil pattern.

2. The multilayered power inductor according to claim 1, wherein when the magnetic layer is included in the whole of the chip, the magnetic layer is made of only the metal powder insulated along the grain interface of the metal powder.

3. The multilayered power inductor according to claim 1, wherein the metal powder in the insulated metal powder uses D50 having 25 to 40 μm.

4. The multilayered power inductor according to claim 1, wherein the metal powder in the insulated metal powder is one or more selected from a group consisting of NiZnCu ferrite, iron (Fe), nickel (Ni), and an alloy with other metals.

5. The multilayered power inductor according to claim 1, wherein the $SiO_2$-based ceramic material includes $Fe_2O_3$.

* * * * *